US006087605A

United States Patent [19]

Heidenfels et al.

[11] Patent Number: 6,087,605

[45] Date of Patent: Jul. 11, 2000

[54] PUSHBUTTON SWITCH

[75] Inventors: Walter Heidenfels; Damianos Papadopoulos, both of Wuppertal, Germany

[73] Assignee: K. A. Schmersal GmbH & Co., Germany

[21] Appl. No.: 09/116,394

[22] Filed: Jul. 16, 1998

[30] Foreign Application Priority Data

Jul. 17, 1997 [DE] Germany ..... 197 30 680

[51] Int. Cl.[7] ..... H01H 3/12

[52] U.S. Cl. ..... 200/345; 200/341

[58] Field of Search ..... 200/332.2, 61.47, 200/520, 537, 345, 341; 400/490, 495; 116/279, DIG. 28; 340/815.48, 393.3; 273/148 B

[56] References Cited

U.S. PATENT DOCUMENTS

| | | | |
|---|---|---|---|
| D. 343,392 | 1/1994 | Harden et al. | D14/114 |
| 2,484,886 | 10/1949 | Henry . | |
| 2,908,776 | 10/1959 | Nolden et al. | 200/340 |
| 3,974,351 | 8/1976 | Solov et al. | 200/345 |
| 4,297,556 | 10/1981 | Taylor | 200/330 |
| 5,134,259 | 7/1992 | Page, Jr. | 200/341 |
| 5,201,409 | 4/1993 | Martin et al. | 200/345 |

FOREIGN PATENT DOCUMENTS 1503139 3/1978 United Kingdom .

OTHER PUBLICATIONS

Euchner—Zustimmungsschalter, Brochure—Copyright Sep. 1990 (No Translation).

*Primary Examiner*—Renee Luebke
*Attorney, Agent, or Firm*—Douglas J. Christensen

[57] ABSTRACT

The invention relates to a pushbutton switch having a ring in which a spring-prestressed button is arranged such that it can be pushed in a predetermined actuating displacement. The button has a top side terminating flush with the top edge of the ring, and from at least one side of the ring parallel to the longitudinal axis of an actuating finger, the edge of the ring is reduced continuously in height substantially to the level of the actuating displacement.

6 Claims, 1 Drawing Sheet

PUSHBUTTON SWITCH

BACKGROUND OF THE INVENTION

The invention relates to a pushbutton switch with a ring and a spring-prestressed button. The button terminates flush with the top edge of the ring, so that on at least one side parallel to the longitudinal axis of an actuating finger, the ring is reduced continuously in height more or less to the level of the actuating displacement.

Round pushbutton switches include those of a diameter of between 15 and 25 mm and which have a ring in which a spring-prestressed button is arranged. The spring-prestressed button is arranged such it can be pushed by a predetermined displacement. Buttons which are planar on the top side and which terminate flush with the top edge of the ring are know. In these cases, the ring serves to fasten the switch for reliable and defined operation for securing against actuation as a result of unintentional contact.

During the pushing-down action, however, the fingertip comes into contact with part of the surrounding ring. In particular individuals who have relatively long fingernails find this awkward or uncomfortable, especially since relatively long fingernails usually also come into contact with the opposite section of the ring.

This problem is eliminated by reducing the actuating displacement of the button. However, this requires, on the one hand, a certain precision motor mechanism and, on the other hand, acoustic or optical acknowledgement of the button actuation.

If the height of the ring as a whole were to be lowered, the button would project, with the result that the ring would lose its function as a means for guiding the finger and securing against incorrect operation.

SUMMARY OF THE INVENTION

The invention relates to a pushbutton switch having a ring in which a spring-prestressed button is arranged such that it can be pushed in a predetermined actuating displacement. The button has a top side terminating flush with the top edge of the ring, and from at least one side of the ring parallel to the longitudinal axis of an actuating finger. The edge of the ring is reduced continuously in height, substantially to the level of the actuating displacement.

The object of the invention is to provide a pushbutton switch which permits convenient actuation of the button, even if the individual concerned has long fingernails, without losing the function of the ring as a means for guiding the finger without any acknowledgement being necessary.

Further configurations of the invention can be gathered from the following description and the claims.

The invention is explained in more detail hereinbelow with reference to exemplary embodiments illustrated in the attached drawings.

BRIEF DESCRIPTION OF THE DRAWINGS

FIG. 1 is a perspective view of a first embodiment of the pushbutton switch of this invention;

FIG. 2 is a perspective view of a second embodiment of the pushbutton switch of this invention;

FIG. 3 is a perspective view of a third embodiment of the pushbutton switch of this invention.

DETAILED SPECIFICATION

Figure 1:
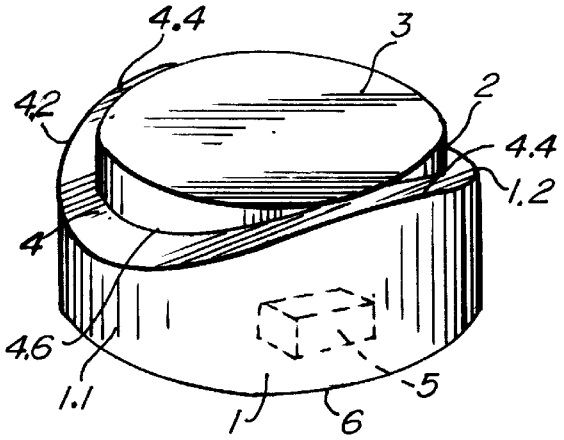
FIGS. 1–3 show, in perspective, different embodiments of round pushbutton switches.

According to the embodiment illustrated in FIG. 1, the round pushbutton switch, which is of an external diameter in the range of from approximately 15 to 25 mm, comprises a ring 1 which basically serves to fasten the pushbutton switch on an installation surface. The ring 1 receives a button 2 which has a planar top side (upper surface) 3 and is arranged in the ring 1 such that it can be pushed in by a predetermined actuating displacement.

As depicted in FIG. 1 the ring 1 includes opposite sides (portions) 1.1 and 1.2 and has an encircling top border 4. Border 4 displays a top (upper) surface 4.2. Top surface 4.2, in turn, has an uppermost or top edge 4.4. Opposite sides 1.1 and 1.2 of ring 1 are parallel to the longitudinal axis of an actuating finger of an individual actuating the switch. Opposite sides 1.1 and 1.2 have a reduced height as compared to the remainder of top edge 4.4 of top border 4. Border 4 is flush with the planar top side 3 of the button 2 at top edges 4.4 and gradually decreases in height from top edges 4.4 to lowermost edges 4.6. Top edges 4.4 are opposite each other on top surface 4.2 and align to be perpendicular to the longitudinal axis of the actuating finger. The alignment of lowermost edges 4.6 is parallel to the longitudinal axis of the actuating finger. In this embodiment, button 2 is prestressed by spring 5. Spring 5 biases button 2 away from a base 6 of the switch of this invention. An actuating finger presses button 2 toward base 6 to actuate the switch. In this embodiment, button 2 returns to the position depicted in FIGS. 1–3 when the actuating finger releases button 2. Since, during actuation, the fingernail is at a somewhat higher level than the fingertip which effects the actuating action, the height difference provided may be somewhat smaller than the actuating displacement of the button 2.

Figure 3:
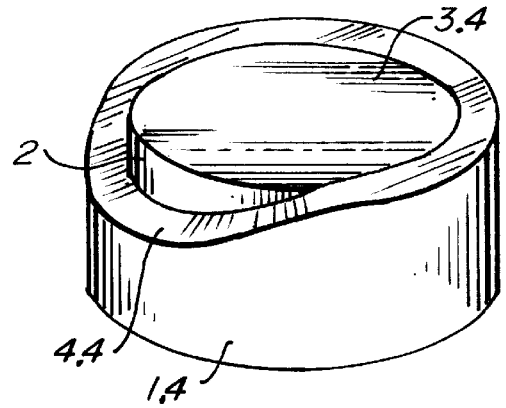
Figure 4:
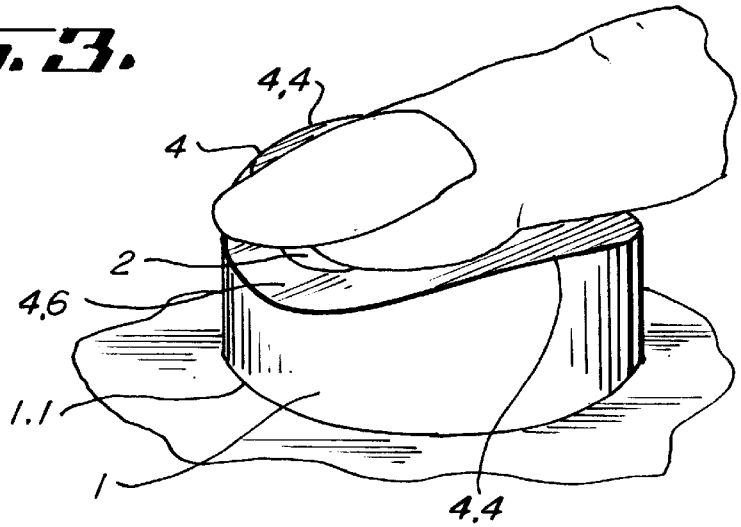
FIG. 4 is a perspective view of the pushbutton switch of FIG. 1 mounted on a surface and being actuated by the finger of a user.

In the case of the embodiment illustrated in FIG. 3, the ring 1.4 is correspondingly reduced in height on just one side.

Figure 2:
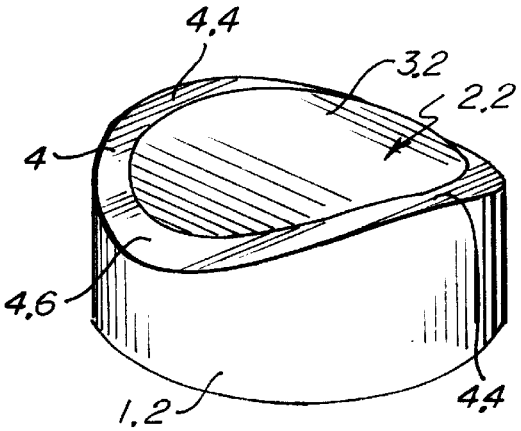

In the case of the embodiment illustrated in FIG. 2, the ring is designed as 1.2. The surface 3.2 of the button 2.2 is adapted to the top border 4.4 of the ring 1.2, with the result that said surface is designed to be flush with said border or edge 4.4.

Even if the individual actuated the button 2 has long fingernails, said button can be actuated conveniently without the ring 1 losing its function as a means for guiding the finger and securing against incorrect operation.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

We claim:

1. A pushbutton switch having a button with an upper surface and a ring that extends around said button, the button displaceable by a finger, the button spring-prestressed and having an actuating displacement to a displaced level, the ring having an upper surface, the ring upper surface having a height which varies, the height of at least one ring surface portion flush with the upper surface of the button when said button is not displaced, said switch being mountable to an installation surface, wherein the upper surface of the ring includes opposite first and second uppermost portions and first and second lowermost portions, and wherein the ring upper surface is reduced identically in height between said first uppermost portion and first lowermost portion and between said second uppermost portion and second lowermost portions.

2. The pushbutton switch as claimed in claim 1, wherein the upper surface of the button is planar.

3. The pushbutton switch as claimed in claim 1, wherein the upper surface of the button is flush with the upper surface of the ring.

4. A pushbutton switch comprising:

a) a ring having an upper surface; and b) an upwardly biased button positioned within the ring, the button having a height and being displaceable downwardly to an actuating displacement, the ring encircling the button, the ring upper surface having an uppermost portion and a lowermost portion, the ring uppermost portion being flush with the height of the button when said button is not displaced downwardly, the upper surface of the ring sloping downwardly from the uppermost portion to the lowermost portion, whereby, when the button is displaced downwardly to the actuating displacement, the height of the button is lowered to the height of the lowermost portion of said ring upper surface, said switch being mountable to an installation surface, wherein the upper surface of the ring includes two opposite uppermost portions and two lowermost portions, and wherein a height of the ring upper surface is reduced identically as the ring surface extends between each adjacent uppermost and lowermost portion.

5. The pushbutton switch of claim 4, wherein the button upper surface is planar.

6. The pushbutton of claim 4, wherein the button upper surface includes a contour which is flush with the upper surface of the ring encircling the button.

* * * * *

UNITED STATES PATENT AND TRADEMARK OFFICE

CERTIFICATE OF CORRECTION

PATENT NO. : 6,087,605 
DATED : July 11, 2000
INVENTOR(S) : Walter Heidenfels and Damianos Papadopoulos It is certified that error appears in the above-identified patent and that said Letters Patent is hereby corrected as shown below:

Column 1,
Lines 17-18, "for securing . . .unintentional contact" should have been deleted.
Line 48, a comma should be inserted after "finger,"

Column 2,
Line 10, a comma should be insereted after "Fig. 1".
Line 42, "actuated" should be -- actuating --.

Signed and Sealed this

Thirtieth Day of July, 2002

*Attest:*

*Attesting Officer*

JAMES E. ROGAN
*Director of the United States Patent and Trademark Office*